US005634802A

United States Patent [19]

Kerklaan

[11] Patent Number: 5,634,802

[45] Date of Patent: Jun. 3, 1997

[54] RETRACTABLE EXPANDABLE JACK

[75] Inventor: Albert J. Kerklaan, Milton, Canada

[73] Assignee: International Business Machines Corporation, Armonk, N.Y.

[21] Appl. No.: 516,591

[22] Filed: Aug. 18, 1995

[30] Foreign Application Priority Data

Aug. 18, 1994 [CA] Canada ..... 2130410

[51] Int. Cl.[6] ..... H01R 13/44

[52] U.S. Cl. ..... 439/131; 439/676; 439/946

[58] Field of Search ..... 439/131, 676, 439/946

[56] References Cited

U.S. PATENT DOCUMENTS

| | | | |
|---|---|---|---|
| 4,946,401 | 8/1990 | Hori et al. | 439/676 X |
| 5,087,208 | 2/1992 | Chang | 439/676 X |
| 5,183,404 | 2/1993 | Aldous et al. | 439/676 X |

FOREIGN PATENT DOCUMENTS

| | | |
|---|---|---|
| 012532 | 6/1980 | European Pat. Off. . |
| 585179 | 3/1994 | France . |
| 403174 | 8/1933 | United Kingdom . |

*Primary Examiner*—David L. Pirlot
*Assistant Examiner*—Daniel Wittels
*Attorney, Agent, or Firm*—Martin J. McKinley

[57] ABSTRACT

The expandable jack has first and second members attached by a pivotal connection. The members can be expanded about the pivotal connection to form a receptacle for receiving a plug and, when not in use, the members can be collapsed about the pivotal connection to fit into storage spaces of reduced size. The jack is of particular use in application interface cards for laptop, notebook and palmtop computers. In such cards, the jack is mounted on a platform which is movable between an exposed position, external of the card, and a retracted storage position within the body of the card. A plug can be inserted into the expandable jack while avoiding interference with obstructions, such as a cable extending from an adjacent card in the computer.

20 Claims, 5 Drawing Sheets

RETRACTABLE EXPANDABLE JACK

BACKGROUND OF THE INVENTION

Applicant claims the foreign priority benefits under 35 U.S.C. 119 of Canadian Patent Application No. 2,130,410 filed Aug. 18, 1994, which is incorporated by reference into this application.

This invention relates to a receptacle jack for accepting a plug and, in particular, a receptacle jack for use in an application interface card such as is used in laptop, notebook and palmtop computers.

The transmission of data by telephone or network lines is a continuously expanding field supported by vast numbers of public and private networks and databases. The data transmitted over telephone and network lines is communicated to and from a computer through suitable interface means such as modems or network adapter units. Physical and electrical connection is provided between the line and the interface by connectors such as the RJ-type or the 8-pin modular plugs, which are accepted by suitable receptacle jacks. The type of plug encountered depends on the form of communication line which is attached to the plug.

The development of reduced size notebook, laptop and palmtop computers has required the concurrent development of modems and network adapters of suitable size to fit within the housings of these computers.

As a result, PCMCIA interface application cards have been developed to house the required interface circuitry. These cards are inserted into slots provided in the computer housing and provide an interface between the external communication line and the computer. However, since the standard thicknesses of the interface cards are 3.3 mm (Type I) or 5 mm (Type II), and the standard interconnect plug thicknesses range between 8 and 12 mm, standard internal connection of the plug of the line directly to the card is not possible.

An external Data Access Arrangement (DAA) is available which houses a standard receptacle jack. The DAA attaches to the interface card when the card is in position in a computer slot and extends out to accept a plug. However, such a solution requires that a DAA be carried along with the computer whenever connection to network or telephone lines is anticipated.

Partial receptacle jacks which are mounted on an interface card, or on a platform within the card, are available and avoid the use of DAA's. The partial receptacle requires that the plug be inserted such that a portion of the plug and the attached line extend out generally perpendicularly from the plane of the card face. Thus, the use of partial jacks can interfere with the cable systems of secondary cards in adjacent slots.

It would therefore be an advancement in the art to develop a receptacle jack which is able to be housed in reduced spaces.

It would be a further advancement in the art to provide an interface application card that is not reliant on external devices for connection to connector plugs.

A further advancement in the art would be to provide a 3.3 mm or 5 mm PCMCIA application interface card that is capable of direct interconnect with a connector plug.

A still further advancement would be to provide an interface card having a receptacle jack that does not interfere with cards in adjacent slots.

SUMMARY OF THE INVENTION

A receptacle jack has been provided which can collapse to fit within reduced spaces. The receptacle jack is suitable for use with interface application cards, such as the PCMCIA standard 3.3/5 mm cards, to provide a means for direct interconnect between a connector plug and a card. The receptacle jack can be mounted such that interference with cards in adjacent computer slots is avoided.

Briefly, the invention is an expandable jack for accepting and retaining a plug. The jack includes first and second members that are pivotally connected to allow rotation of the first and second members with respect to each other between an expanded position and a collapsed position. In the expanded position, a receptacle is formed between the first member and the second member which accepts the plug. The jack also includes means for electrical communication with the plug.

In another embodiment, the invention is an application interface card for communication with an interconnecting plug. The card includes a card body and internal interface circuitry. A retractable platform moves in and out of the card and an expandable jack is mounted on the platform. The jack can be expanded to form a receptacle when positioned external of the card, or the jack can be collapsed for storage within the card.

BRIEF DESCRIPTION OF THE DRAWINGS

A further, detailed, description of the invention, will follow by reference to the following drawings of specific embodiments of the invention, which depict only typical embodiments of the invention and are, therefore, not to be considered limiting of its scope.

DESCRIPTION OF THE ILLUSTRATIVE EMBODIMENTS

Figure 1:
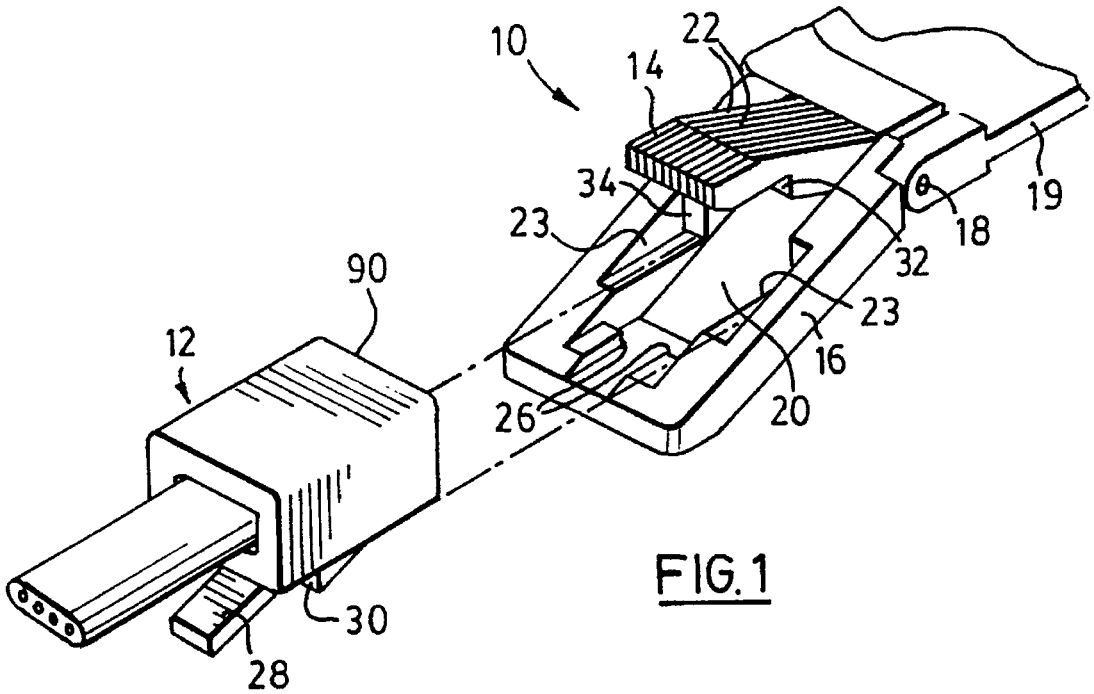
FIG. 1 shows a perspective view of a jack of the present invention in an expanded position and having a plug aligned for insertion into the receptacle of the jack.

The invention provides an expandable receptacle jack comprising a first member and a second members wherein the first member is pivotally connected to the second member to allow the rotation of the first and second members with respect to each other between an expanded position and a collapsed position. In the expanded position, a receptacle is formed between the first and second member which is sized and shaped to accept, and provide electrical communication with, a connector plug. In the collapsed position, the first and second members rotate about the pivot point to overlie each other such that the jack can be stored in a space of reduced size.

The receptacle can be sized and formed to specifically accept any telephone or network connector plug or the like such as the RJ-type plugs and the 8-pin modular plugs. Electrical contact pins are provided in the receptacle on a selected one of the first or second members such that, when the plug is inserted into the receptacle, the contacts of the plug will make contact with the contact pins of the jack to communicate electrical signals therethrough. Contact pins are at least exposed for communication with the plug on the inner surfaces of the receptacle and can be exposed along their entire length. Alternatively, to reduce the risk of damage to the pins, the portion of the contact pins which is not required for making contact can be covered by, for example, embedding in the material of the jack, which can be, for example, an insulating polymer such as a polycarbonate, or covering with a protective coating.

The contact pins of the jack are in communication with associated circuitry to which signals received via the plug are passed. Such communication can be accomplished by hard-wiring between the jack and the circuitry or by suitable contacts which permit unrestricted movement of the jack or removal of the jack from the circuitry, if desired.

The receptacle is sized and shaped to accept and retain the plug. Various means can be provided in the receptacle, or adjacent the receptacle, to facilitate the acceptance and retention of the plug. For example, to retain the RJ-type and 8-pin modular plugs, the receptacle is preferably provided with at least one flange for engaging the lock clip of the plug. The flange is capable of engaging the shoulder of the lock clip as tension produced between the lock clip and the receptacle urges the shoulder of the lock clip behind the flange, as the plug is pushed into the receptacle. Preferably, the receptacle will also be provided with means formed on the inner surfaces of the first and second members, such as side and/or end walls, to prevent the overinsertion of the plug into the receptacle and to ensure that the plug is placed within the receptacle to make electrical contact with the contact pins in the jack.

The contact pins, flanges and end wall, when provided, are positioned within the receptacle to accept and correspond with the plug. However, these features can be provided on either the first or second member according to choice.

To facilitate the expansion of the first and second members, the members are preferably biased in the expanded position. To collapse the jack, force must be applied to cause the first and second members to rotate towards and overlie each other. The biasing means can be provided by any suitable means such as, for example, a spring acting about the pivot point or a resilient member or spring acting between the members.

The expansion of the jack is preferably restricted to prevent the overexpansion of the members. The first and second members are prevented from overexpansion by any suitable means such as, for example, by an encasement disposed about the members, abutting flanges acting between the members and the mount, or by providing each of the members with an extension disposed on the side of the pivot point remote from the receptacle which act to abut each with the other when the receptacle is a predetermined size.

To further reduce the thickness of the jack in the collapsed position, the members are preferably shaped to overlie and fit within each other.

The jack of the present invention can be carried on any suitable mount. In the preferred embodiment, the jack is used with a PCMCIA card to provide direct electrical contact between an interconnect plug and interface circuitry contained within the card. The jack is mounted on a retractable platform which retracts to a slot formed in the card. The retractable platform can be moved between a retracted position, in which the collapsed jack is retained within the confines of the card slot, and an exposed position in which the jack is external of the slot and is free to expand for use. In this expanded position, a plug can be inserted into the receptacle of the jack to allow electrical connection between the telephone or network communication line and the computer, through the card. The plug can be inserted along an axis parallel to the plane of the face of the card and allows the line to extend out without interfering with adjacent card slots on the computer.

After use, the platform is retracted to be carried internally when not in use. When the jack comes into contact with the slot of the card, the first and second members of the jack collapse into overlying relation to allow the storage of the jack within the confines of the card slot. To facilitate the collapsing of the jack the first and second members are preferably tapered along a leading edge that first comes into contact with the slot.

For use in a 3.3 mm PCMCIA card, the jack must, in the collapsed position, have a thickness no greater than about 3 mm. A preferred thickness of 2.9 mm has been found to allow insertion of the jack into the card and to maintain adequate strength and stability in the jack.

A portion of the retractable platform remains in engagement with the card and the mounted jack thereby remains in communication with the card circuitry through suitable electrical connections. In use, the retractable platform is moved between the retracted position and the exposed position by any suitable means such as, for example, by rotation about a pivot point or by sliding along rail or channel arrangements. The positioning of the platform can be controlled by locking means that lock the platform in the exposed and/or retracted position. The use of the platform can be facilitated by providing a means for biasing the platform in an exposed position.

The upper and lower members of the jack are preferably mounted on the retractable platform such that they are capable of movement that is generally perpendicular to the plane of movement of the retractable platform, while maintaining the receptacle for insertion of a plug. In this way, the jack is able to be biased out of the way of obstructions such as the cable systems of cards in adjacent slots. In the preferred embodiment, a biasing means is provided to maintain the jack in a plane parallel to the plane of movement of the platform, unless force is applied to the jack.

For the purposes of example, jacks and plugs described and illustrated are of the RJ-11 6-pin type, but it is to be understood that the jack of the present invention can be modified to correspond to any interconnect plug such as, for example, RJ-45, RJ-11 or 8-pin modular plugs.

While the jack of the present invention is described with reference to its use in computers, it is to be understood that the jack is of use in any application in which a jack capable of storage in reduced spaces is required, such as in telephone equipment or wall mounts.

Figure 2:
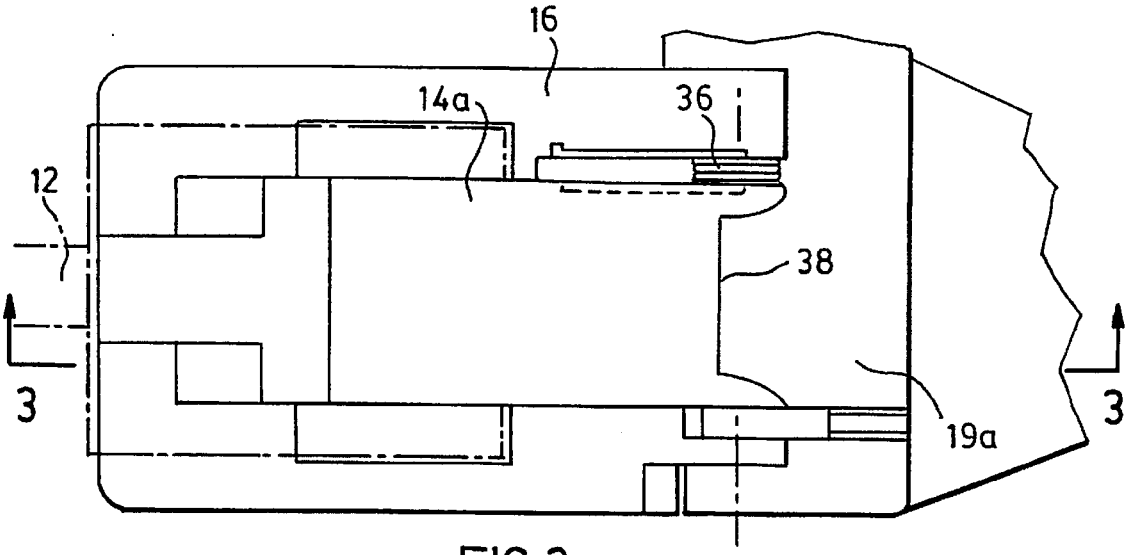
FIG. 2 shows a plan view of another embodiment of a jack of the present invention.
Figure 3:
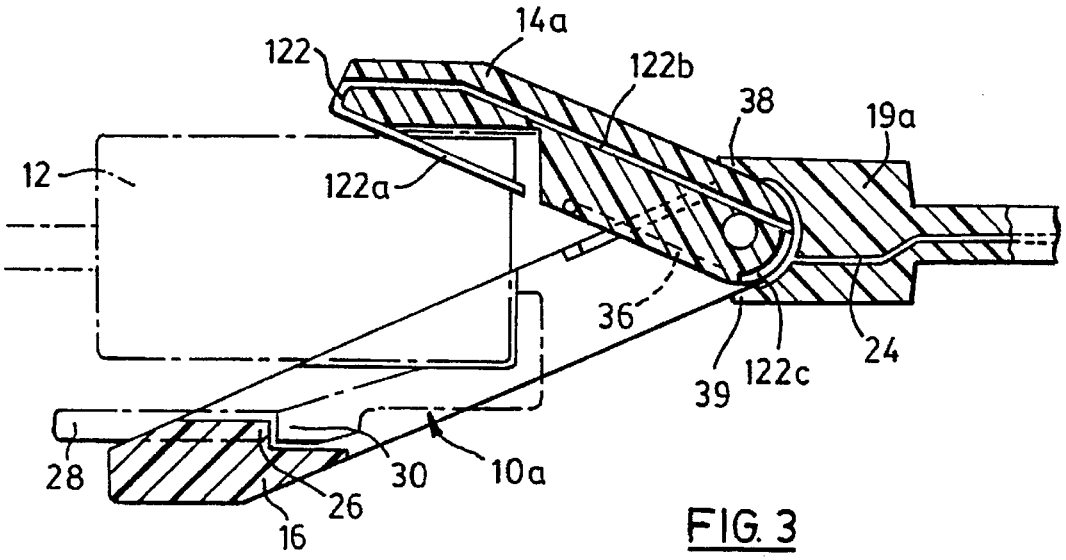
FIG. 3 shows a sectional view of the jack taken along line 3—3 of FIG. 2.
Figure 4:
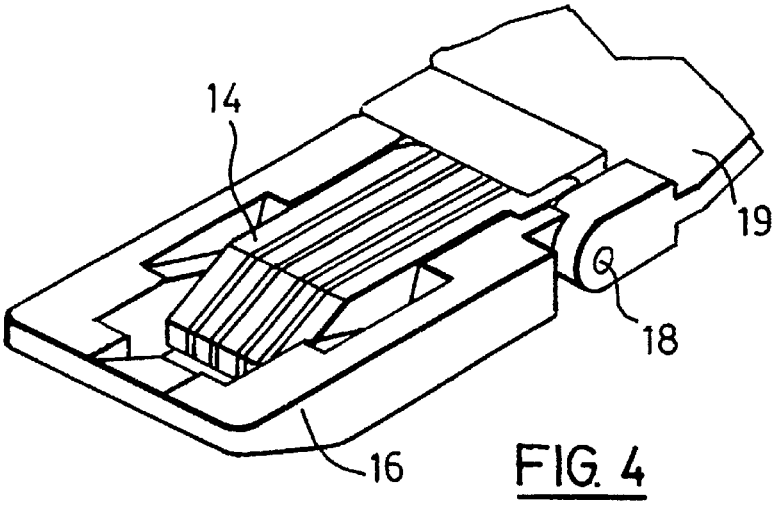
FIG. 4 shows a perspective view of a jack in a collapsed position.

Referring to FIGS. 1 to 3, a jack 10 (FIG. 1) or a slightly modified jack 10*a* (FIGS. 2 and 3) is shown in the expanded position for insertion of an interconnect plug 12 (shown in phantom in FIGS. 2 and 3). Jack 10 or 10*a* comprises a first member 14 or 14*a*. Jacks 10 and 10*a* differ only that member 14 of jack 10 has contact pins 22 on its outer surface while, in jack 10*a*, the corresponding member 14*a* has contact pins 122 embedded in it, and such pins protrude only where contacts are desired. A second member 16 is pivotally attached to member 14 or 14*a* at pivotal connection 18 and carried on any suitable mount 19, 19*a*. Connection 18 allows rotation of members 14 or 14*a* and 16 with respect to each other between an expanded position, as shown, and a collapsed position, as shown in FIG. 4. In the expanded position, first and second members, 14 (or 14*a*), 16, define a receptacle 20 therebetween. Receptacle 20 is formed and sized to accept and retain plug 12. In the preferred embodiment, the upper limits of receptacle 20 are defined by the inner facing surface of first member 14 or 14*a*. Receptacle 20 contains contact pins 22 or 122, secured on first member 14, for contact with the contacts 90 exposed on plug 12. The inner facing surface of second member 16 defines the lower limits of receptacle 20. In addition, ledges 23 formed on the inner facing surface of second member define the side limits of receptacle 20 and ensure the proper lateral positioning of plug 12 within receptacle 20.

Contact pins 22 can be exposed along their entire length extending from receptacle 20, along the outer surface of first member 14 to their point of connection to associated circuitry (not shown), or alternatively, as shown in FIG. 3, contact pins 122 can be exposed only at portions where electrical contact with other contacts is required such as the portion 122*a* of the pins in receptacle 20 or the portion 122*c* of pins in the area where the pins make contact with the leads 24 of the mount 19*a* (where such connection has not been hard wired). The portion 122*b* of contact pins which is not required for making electrical contact is embedded in the material of the jack 10*a* or covered by a protective coating. In this way, the risk of damage to the contact pins 122 is reduced.

In the preferred embodiment for use with RJ-type or 8-pin modular plugs, receptacle 20 firmly retains plug 12 by means of retaining flanges 26 which engage a lock clip 28 on the plug 12. Flanges 26 are disposed to engage the shoulders 30 of lock clip 28 when shoulders 30 are forced behind flanges 26 upon insertion of the plug into the receptacle.

In the preferred embodiment, ledges 32, 34 are provided on members 14, 14*a*, 16, respectively, to limit the insertion of the plug into the receptacle and to ensure proper placement of the plug within the receptacle.

As shown in FIG. 4, the jack is preferably formed to collapse such that first member 14 overlies and fits within second member 16. In particular, in the preferred embodiment, second member 16 is generally U-shaped and first member 14 is of suitable size to fit between the arms of the second member.

In the preferred embodiment, as best seen in FIGS. 2 and 3, first member 14*a* and second member 16 are biased in the expanded position by means of a coil spring 36 acting between the members. Thus, jack 10*a* is collapsed only by applying and maintaining pressure on the members. To prevent over-expansion of the members, abutting flanges 38, 39 are provided on mount 19*a* which act against the outer surfaces of members 14*a* and 16, respectively.

Figure 5A:
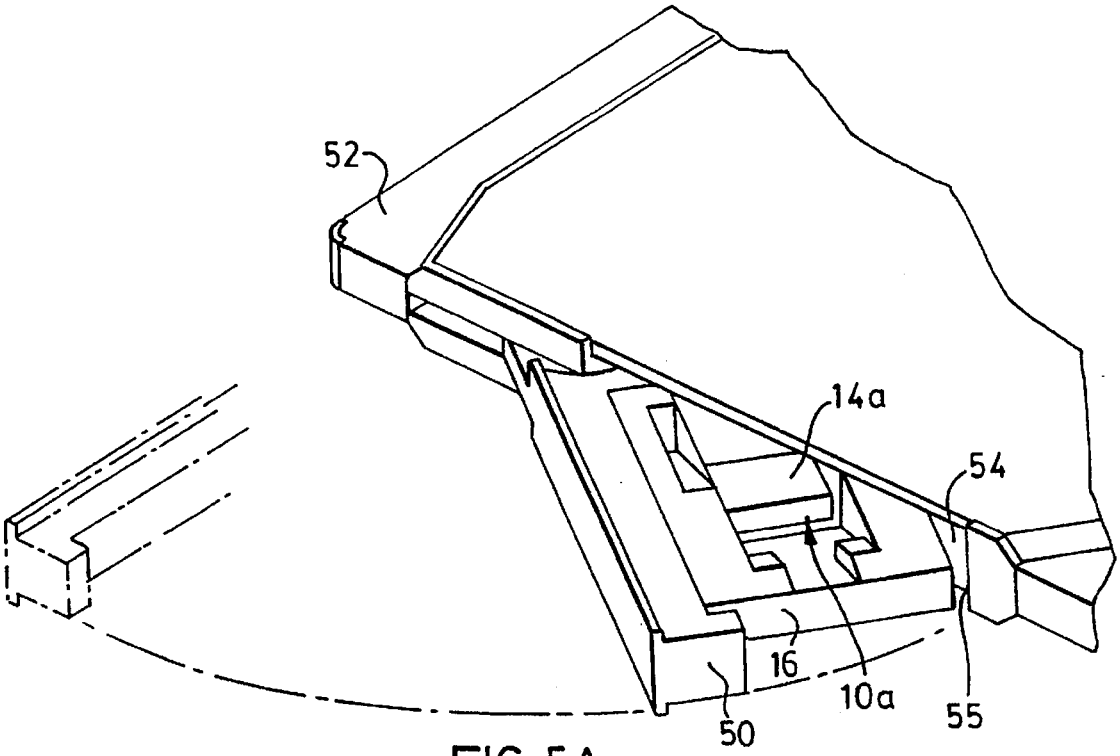
FIGS. 5A and 5B show a partially cut away perspective view of another embodiment of the invention having a retractable platform mounted in an application interface card and movable between a retracted position and an exposed position.
Figure 5B:
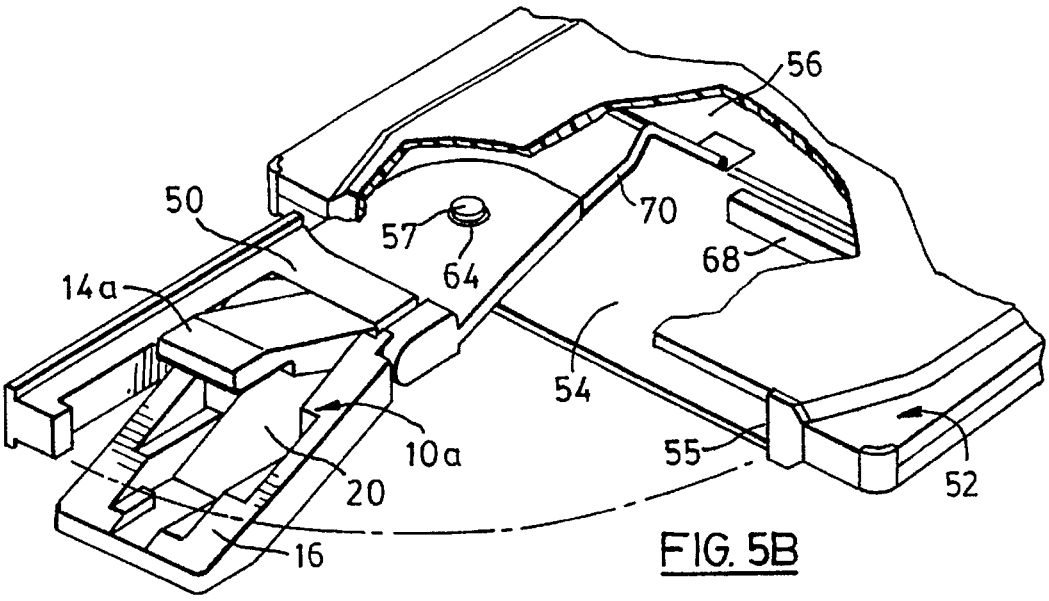

Referring to FIGS. 5A and 5B, the jack of the present invention can be of use with a PCMCIA interface application card. In this embodiment, jack 10*a* of the present invention is mounted on a retractable platform 50 which is stored internally of card 52 in slot 54. Platform 50 rotates on pivotal connection 57 to move in and out of slot 54 between a retracted position and an exposed position, while remaining in engagement with the card. Platform 50 carries jack 10*a* and thereby acts to move jack 10*a* between a stored position, in which jack 10*a* is collapsed and retained within the confines of slot 54, and a position in which the jack is external of slot 54 and is able to expand for use. Jack 10*a* is connected to interface circuitry 56 contained within card 52 and allows for insertion of an interconnect plug into the application interface card when the jack is in position external of the card. Jack 10*a* is mounted on platform 50 such that a plug can be inserted along an axis substantially parallel to the plane defined by the face of the card.

Referring to FIGS. 5A and 5B, jack 10*a* is normally maintained in the collapsed position within slot 54, wherein first member 14*a* overlies and fits within second member 16, when not in use. Although, in the preferred embodiment, jack 10*a* comprises biasing means which would cause members 14*a*, 16 to assume an expanded position, jack 10*a* is maintained in this collapsed position within the slot by the walls 55 of the slot acting against the biasing means. During rotation of the platform from the retracted position to the exposed position, platform 50 passes out of slot 54 to position jack 10*a* external of card 52. As jack 10*a* passes out of slot 54, biasing means acting between first and second members 14, 16 cause jack 10*a* to expand to form receptacle 20. This receptacle is then ready to receive a plug (not shown). In FIG. 5A, the jack has been partially rotated out of slot 54, and walls 55 of the slot are still acting to keep it collapsed. In FIG. 5B, members 14 and 16 have rotated fully out of the slot, and the biasing means have caused the jack to be expanded.

When jack 10*a* is no longer required for use, retractable platform 50 is retracted into card 52. During retraction, jack 10*a* is collapsed to fit within the card when members 14*a*, 16 come into contact with the walls of slot 54. Outer surfaces of members 14*a* and 16 are smoothly tapered to facilitate the collapsing of the jack.

Jack 10*a* is preferably connected to an integrated circuit board 56 contained within the card by means of a flexible connector 70. Flexible connector 70 can be carried on platform 50 or can extend freely from the jack to the board. By use of flexible connector 70, the jack and platform are free to move while communication between the contact pins in the jack and the circuitry is maintained.

Since jack 10*a* is in constant communication with circuit board 56 through flexible connector 70, the jack can act at any stage of rotation of the platform. In this way, if obstructions are present near the card slot of the computer, jack 10*a* can be used by exposing platform 50 only enough to allow expansion of the jack to form receptacle 20.

Figure 6:
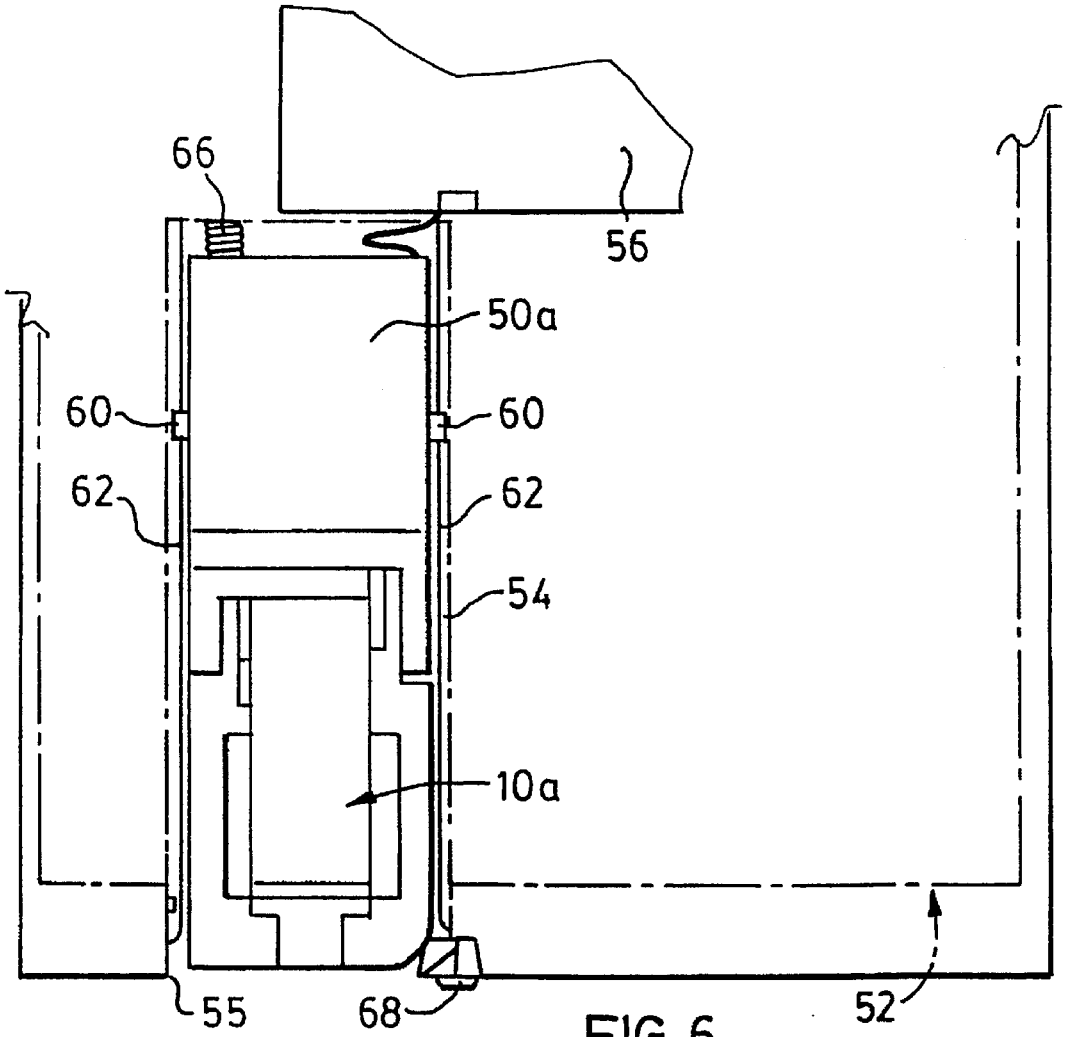
FIG. 6 shows a plan view of an alternate embodiment of a retractable platform mounted in an application interface card.

In the embodiment shown in FIGS. 5A and 5B, retractable platform 50 is moved between the retracted position and the exposed position by rotation about a pivotal connection 57. In an alternate embodiment, shown in FIG. 6, retractable platform 50*a* is moved by sliding guides 60 along sliding rails or channels 62. To facilitate the movement of platforms 50, 50*a*, biasing spring means 64, 66, respectively, are provided between the cards and the platforms to bias them in the exposed position. To retract such platforms, the platforms are forced against the action of the biasing means and locked into retracted position within their respective cards by means of a suitable locking means such as a spring-actuated lock 68 or catch 69. Where spring biasing is not used in association with a platform, a releasable locking means may be provided to maintain the platform in the exposed position.

Figure 7:
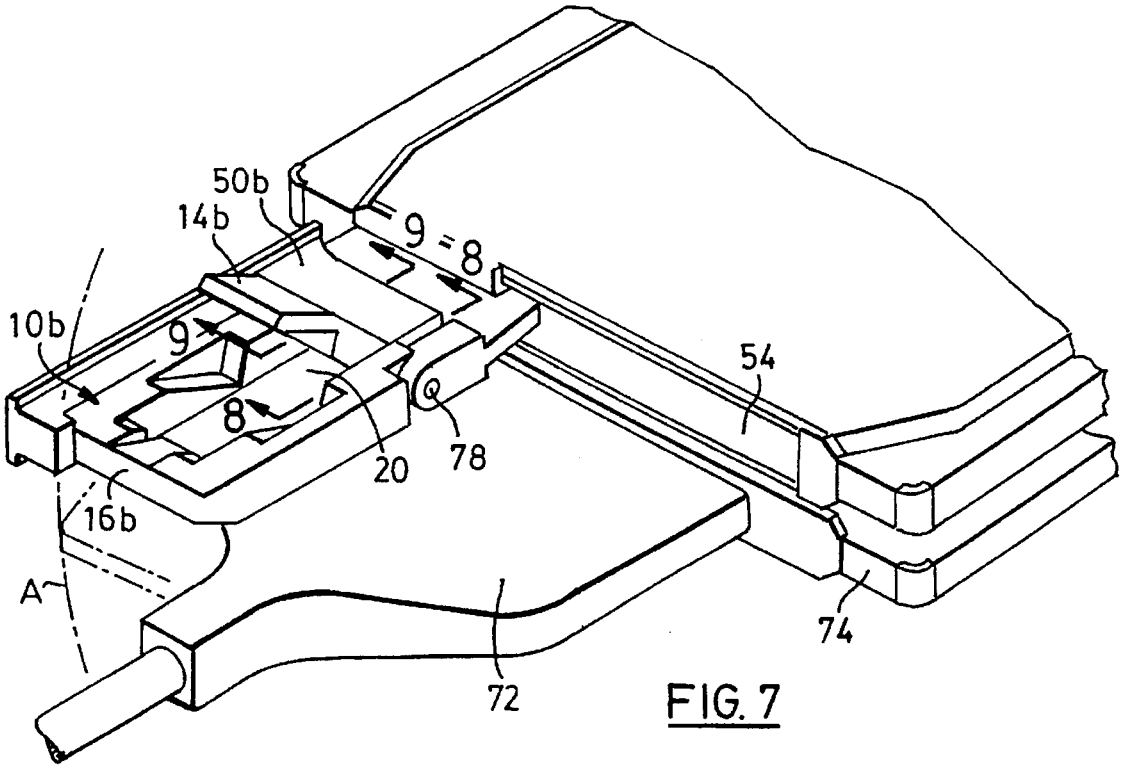
FIG. 7 shows a perspective view of another alternate embodiment of a jack of the present invention which is rotatable to avoid an obstruction.

In the embodiment shown in FIG. 7, upper and lower members 14*b*, 16*b* are mounted on platform 50*b* such that they are capable of movement which is generally perpendicular to the plane of rotation of platform 50*b* in and out of slot 54 while maintaining receptacle 20 in the expanded position for insertion of a plug (not shown). In this way, jack 10*b* can be biased out of the way of obstructions such as a cable system 72 extending from an adjacent card 74. In the preferred embodiment, jack 10*b* is moved perpendicularly by means of rotation, generally indicated by line A, about a pivotal connection formed as a hinge pin 78 onto which members 14*b*, 16*b* are journaled. Hinge pin 78 is retained in platform 50*b* at its ends and acts to mount securely jack 10*b* to platform 50*b*.

Figure 8:
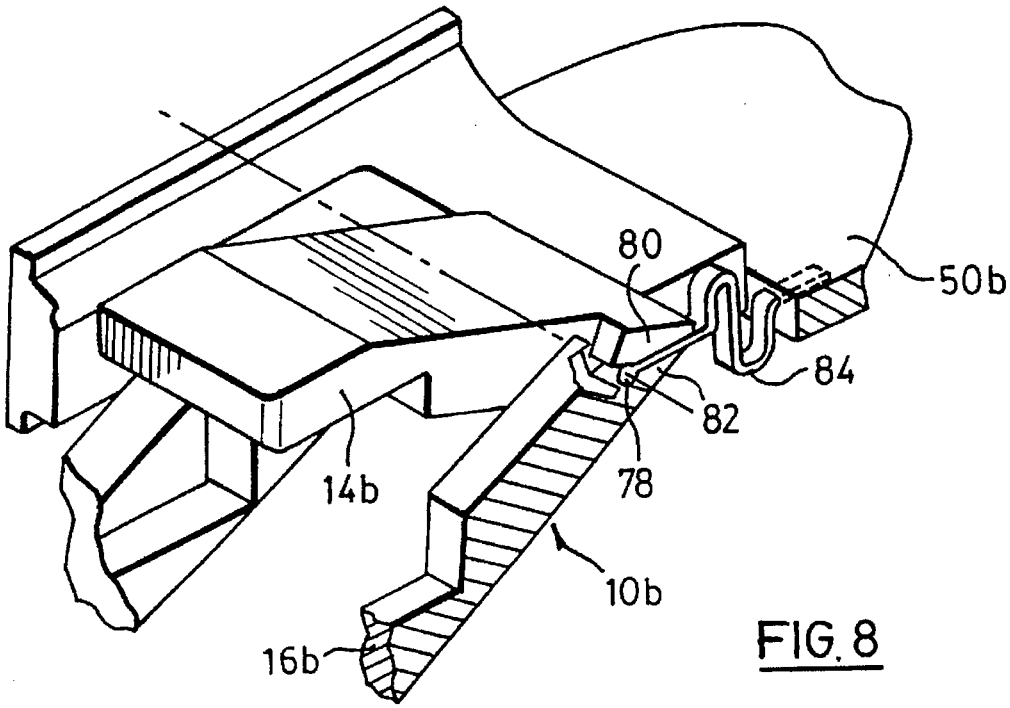
FIG. 8 shows a sectional view of the jack taken along line 8—8 of FIG. 7; and, FIG. 9 shows a sectional view of the jack taken along line 9—9 of FIG. 7.

As shown in FIG. 8, when jack 10*b* is free to rotate about hinge pin 78, over-expansion of members 14*b*, 16*b* is prevented by providing each of the members with an extension 80, 82, respectively, disposed on the side of hinge pin 78, remote from receptacle 20. Extensions 80, 82 are formed to be diverged from each other, when members 14*b*, 16*b* are in the collapsed position and to abut when members 14*b*, 16*b* are rotated about hinge pin 78 to form receptacle 20. Extensions 80, 82 are of a length such that they do not increase the thickness of the collapsed jack or impede the storage of the jack within slot 54.

Jack 10*b* is biased such that receptacle 20 remains in a plane parallel to the plane of rotation of platform 50*b*, unless force is applied to rotate jack 10*b* about hinge pin 78. Such biasing can be provided by a resilient member such as for example an S-spring 84 extending between platform 50*b* and jack 10*b*.

Figure 9:
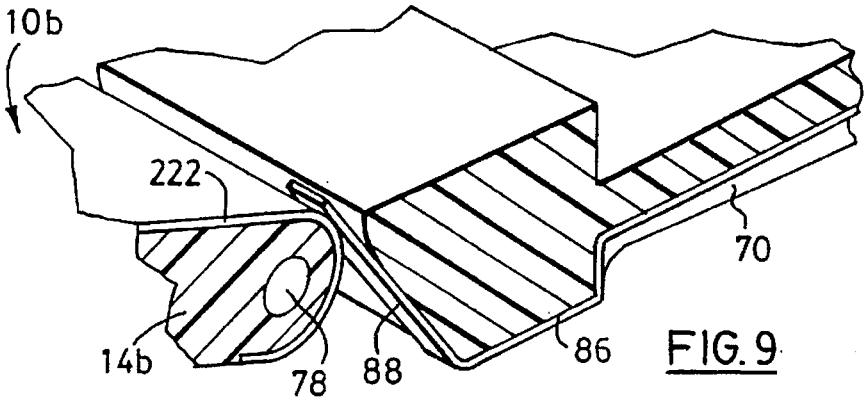

Referring to FIG. 9, electrical contact between contact pins 222 of jack 10*b* and leads 86 is preferably maintained throughout rotation of jack 10*b* on hinge pin 78 by use of an extended contact. In particular, contact pins 222 on first member 14*b* are exposed and extend a suitable distance about the end of the first member adjacent platform 50*b* such that leads 86 having extended contacts 88, positioned to make contact with contact pins 222, can make electrical contact with the contact pins regardless of the degree of rotation of member 14*b* about hinge pin 78.

It will be apparent that many other changes may be made to the illustrative embodiments, while falling within the scope of the invention and it is intended that all such changes be covered by the claims appended hereto.

I claim:

1. An expandable jack for accepting and retaining a plug, the jack comprising:

a first member; and, a second member;

the first member being pivotally connected to the second member to allow rotation of the first and second members with respect to each other between an expanded position and a collapsed position and wherein in the expanded position a receptacle is formed between the first member and the second member which accepts the plug and comprises means for electrical communication with the plug, wherein the means for electrical communication comprise a plurality of contact pins exposed within the receptacle.

2. The expandable jack as claimed in claim 1, wherein the jack is attached to a mount for communication with related circuitry.

3. The expandable jack as claimed in claim 2, wherein the contact pins of the jack are hard wired to the related circuitry.

4. The expandable jack as claimed in claim 2, wherein communication of the jack to the related circuitry is provided by means of electrical contact between the contact pins and contacts of the related circuity.

5. The expandable jack as claimed in claim 1, wherein the jack is mounted for communication with the internal circuitry of an application interface card.

6. The expandable jack as claimed in claim 5, wherein the jack is mounted on a retractable platform for movement in and out of the card.

7. An expandable jack for accepting and retaining a plug, the jack comprising:

a first member; and, a second member;

the first member being pivotally connected to the second member to allow rotation of the first and second members with respect to each other between an expanded position and a collapsed position and wherein in the expanded position a receptacle is formed between the first member and the second member which accepts the plug and comprises means for electrical communication with the plug, wherein the receptacle is formed to accept an RJ-type plug.

8. An expandable jack for accepting and retaining a plug, the jack comprising:

a first member; and, a second member;

the first member being pivotally connected to the second member to allow rotation of the first and second members with respect to each other between an expanded position and a collapsed position and wherein in the expanded position a receptacle is formed between the first member and the second member which accepts the plug and comprises means for electrical communication with the plug, wherein the receptacle is formed to accept an 8-pin modular plug.

9. An expandable jack for accepting and retaining a plug, the jack comprising:

a first member; and, a second member;

the first member being pivotally connected to the second member to allow rotation of the first and second members with respect to each other between an expanded position and a collapsed position and wherein in the expanded position a receptacle is formed between the first member and the second member which accepts the plug and comprises means for electrical communication with the plug, wherein the jack is biased in the expanded position.

10. An expandable jack for accepting and retaining a plug, the jack comprising:

a first member; and, a second member;

the first member being pivotally connected to the second member to allow rotation of the first and second members with respect to each other between an expanded position and a collapsed position and wherein in the expanded position a receptacle is formed between the first member and the second member which accepts the plug and comprises means for electrical communication with the plug, wherein the jack further comprises means to prevent overexpansion of the jack.

11. An expandable jack for accepting and retaining a plug, the jack comprising:

a first member; and, a second member;

the first member being pivotally connected to the second member to allow rotation of the first and second members with respect to each other between an expanded position and a collapsed position and wherein in the expanded position a receptacle is formed between the first member and the second member which accepts the plug and comprises means for electrical communication with the plug, wherein the jack further comprises a means for retaining the plug within the receptacle disposed on a selected one of the first member and the second member and wherein the means for electrical communication with the plug is disposed on the other of the first member and the second member.

12. The expandable jack as claimed in claim 11, the means for retaining the plugs comprises at least one flange for engaging a lock clip of the plug, and the jack further comprising a means to ensure proper positioning of the plug within the receptacle.

13. An application interface card for communication with an interconnector plug, the card comprising:

a card body and internal interface circuitry;

a retractable platform for moving in and out of the card; and, an expandable jack mounted on the platform and capable of communication with the circuitry of the card, the jack being capable of expanding to form a receptacle when in position external of the card and of collapsing for storage within the card.

14. The application interface card as claimed in claim 13 wherein the jack is mounted on the platform such that the receptacle is disposed to accept a plug which is inserted along an axis substantially parallel to a plane formed by the card's face.

15. The application interface card as claimed in claim 14 wherein the jack is mounted on the platform to be moveable, with respect to the platform, to avoid interference with obstructions which would prevent insertion of the plug.

16. The application interface card as claimed in claim 15 wherein the jack is mounted by means of a hinge pin to the platform and the jack is rotatable about the hinge pin.

17. The application interface card as claimed in claim 16 wherein the jack is biased in position on the platform such that the receptacle is disposed to accept a plug which is inserted into the receptacle along an axis substantially parallel to the plane formed by the card's face and is rotatable about the hinge pin by application of force to the jack.

18. The application interface card as claimed in claim 13 wherein the jack comprises:

a first member; and, a second member;

the first member being pivotally connected to the second member to allow rotation of the first and second members with respect to each other between an expanded position and a collapsed position and wherein in the expanded position a receptacle is formed between the first member and the second member which accepts the plug and comprises means for electrical communication with the plug.

19. The application interface card as claimed in claim 18 wherein the means for electrical communication with the plug are contact pins and such pins are hard wired to the internal interface circuitry.

20. The application interface card as claimed in claim 18 wherein the means for electrical communication with the plug are contact pins and such pins are in communication with the internal interface circuitry by contact with contacts of the internal interface circuitry.

* * * * *